US006921292B2

(12) United States Patent
Miyazaki

(10) Patent No.: US 6,921,292 B2
(45) Date of Patent: Jul. 26, 2005

(54) CONNECTOR HAVING SHIELDING SHELL

(75) Inventor: Sho Miyazaki, Aichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/716,516

(22) Filed: Nov. 20, 2003

(65) Prior Publication Data

US 2004/0106325 A1 Jun. 3, 2004

(30) Foreign Application Priority Data

Nov. 21, 2002 (JP) ..... 2002-338285
Nov. 21, 2002 (JP) ..... 2002-338286
Nov. 21, 2002 (JP) ..... 2002-338287

(51) Int. Cl.[7] ..... H01R 13/648
(52) U.S. Cl. ..... 439/564; 439/607; 439/939
(58) Field of Search ..... 439/607, 610, 439/98, 99, 939, 550, 559, 562, 563, 564, 555, 573, 95

(56) References Cited

U.S. PATENT DOCUMENTS 5,755,597 A * 5/1998 Panis et al. ..... 439/610
2002/0048994 A1 * 4/2002 Oota et al. ..... 439/607
2002/0081904 A1 * 6/2002 Ko ..... 439/610

FOREIGN PATENT DOCUMENTS

JP 9-161892 6/1997
JP 11-026093 1/1999

* cited by examiner

*Primary Examiner*—Ross Gushi
(74) *Attorney, Agent, or Firm*—Oliff & Berridge, PLC

(57) ABSTRACT

A connector includes: a plurality of terminals fixedly attached to an end portion of a plurality of wires and configured to be connected to the terminals of the equipment, respectively; a housing configured to retain the plurality of terminals and to be fit into the mounting hole; and a shielding shell having conductive characteristic and fixedly attached to an end portion of a cylindrical shielding member enclosing the plurality of wires collectively, and configured to be connected to the shielding casing.

16 Claims, 9 Drawing Sheets

CONNECTOR HAVING SHIELDING SHELL

BACKGROUND OF THE INVENTION

1. Field of the Invention

The present invention relates to a connector having shielding shell to be connected to equipment such as an inverter unit or a motor for an electric vehicle.

2. Description of the Related Art

A conventional connector used for connecting a plurality of shielded wires to equipment such as an inverter unit in an electric vehicle includes a shielding shell.

The conventional connector used for such purpose, as disclosed in JP-A-11-026093, is structured in that wire-side terminals are fixedly attached to conductors of shielded wires and retained in a housing, while a conductive connecting member is fixedly attached to a shielding layer of each shielded wire. When the connector is to be attached to equipment, the housing is plugged into a mounting hole formed in a shielding casing of the equipment, and a bracket formed in the outer circumference of the housing is fixedly connected to the outer surface of the shielding casing, and the wire-side terminals are connected to equipment-side terminals in the shielding casing. Further, the connecting member is fixed to the outer surface of the shielding casing so as to connect the shielding layer of each shielded wire to the shielding casing. Hereinafter, the conventional connector having the structure described above will be referred to as a first conventional connector.

In the first conventional connecter, however, it is necessary to repeat the process of connecting the connecting member to the shielding casing as many times as the number of shielded wires. As a solution to such a problem, a collectively-shielding structure has been considered. The collectively-shielding structure uses a non-shielded wire having no shield layer in place of each shielded wire, and uses a shielding member having a cylindrical braiding made of a metal fine line braided in a mesh like manner, in place of the shielding layer of each shielded wire. A plurality of non-shielded wires are surrounded collectively by the shielding member. According to the structure above, the step of connecting the shielding member to the shielding casing can be performed at one time. Thus, the workability is improved.

When the collectively-shielding structure is adopted, the shielding member is conductively connected to the shielding casing by: fixedly attaching the opening edge portion of the shielding member to a cylindrical shielding shell; bring a flange portion formed in the circumferential edge portion of the shielding shell into close contact to the outer surface of the shielding casing; and fixing the flange portion by bolting.

In addition, as described above, a positioning bracket projects over the outer circumference of the housing. In order to fix the bracket to the shielding casing, it is necessary to provide a notch portion in a part of the flange portion, and make the bracket project to the outside of the shielding shell through the notch portion. Therefore, the flange portion is not continuous over the whole circumference, but is disconnected in the notch portion.

As a technique for forming the shielding shell, a method using a process called deep drawing out of a metal material in a flat plate shape is adopted as follows. That is, a cylindrical portion thereof is formed gradually out of a flat plate portion, while a part of the flat plate portion is left as a flange portion. In the technique described above, the flange portion may be deformed in a curved shape in the course of working the cylindrical portion. Particularly when the flange portion has a shape that is' not continuous over the whole circumference as described previously, a curve is apt to occur and the degree of the curve becomes large.

When the flange portion is thus curved, a part of the flange portion may not come in contact with the shielding casing when the shielding shell has been attached to the shielding casing. Thus, the reliability of contact between the shielding shell and the shielding casing may be deteriorated.

Another conventional connector used for above-mentioned purpose, as disclosed in JP-A-9-161892, is structured in that a mounting hole is formed in an outer wall of a casing of the equipment, while equipment-side terminals are provided inside the casing. Wire-side fittings connected to a plurality of wires are retained in one housing, and the housing is fitted into the mounting hole. Thus, wire-side terminals are connected to the equipment-side terminals respectively. In the second conventional connector, a sealing member is provided between the inner circumference of the mounting hole and the outer circumference of the housing in order to secure waterproof inside the casing. Hereinafter, the conventional connector having the structure described above will be referred to as a second conventional connector.

In the second conventional connector, three pole terminals are disposed in a triangle, while the housing for retaining the wire-side terminals is formed to have a round outer circumference. The sealing member having an annular shape is outer-fitted to the round outer circumference of the housing.

When the terminals are disposed in a triangle as described above, it is necessary to secure a certain space in the directions of both the width and the height to dispose the terminals in the space. However, it may be considered that the equipment-side terminals are obliged to be disposed alongside due to some restriction caused by the layout of the equipment or other peripheral parts. In this case, the wire-side terminals have to be also disposed alongside. In accordance with the disposition, therefore, the housing as a whole has to be formed into a noncircular shape long from side to side, such as an elliptic shape, an oval shape or a substantially rectangular shape, and the sealing member to be attached to the outer circumference of the housing has to be also formed into a noncircular shape.

However, in the case where the outer circumference of the housing and the sealing member are formed into a noncircular shape, there is a fear that a part of the sealing member floats from the outer circumference of the housing or may be stretched excessively when the sealing member is out of circumferential position relative to the housing. Assume that the housing is fitted into the mounting hole when the sealing member is attached in such a state. In this event, the close contact state of the sealing member with the outer circumference of the housing and the inner circumference of the mounting hole (the elastic bending state of the sealing member) is not uniform in the circumferential direction. There is a fear that the reliability of the seal function deteriorates.

SUMMARY OF THE INVENTION

It is therefore an object of the invention to provide an equipment shield connecter having an improved reliability in contacting between a shielding shell and a shielding casing.

In order to achieve the object, according to one aspect of the invention, there is provided a connector to be attached to equipment in which a plurality of terminals are provided in a shielding casing and a mounting hole is formed on the shielding casing, the connector including: a plurality of terminals fixedly attached to an end portion of a plurality of wires and configured to be connected to the terminals of the equipment, respectively; a housing configured to retain the plurality of terminals and to be fit into the mounting hole; and a shielding shell having conductive characteristic and fixedly attached to an end portion of a cylindrical shielding member enclosing the plurality of wires collectively, and configured to be connected to the shielding casing.

BRIEF DESCRIPTION OF THE DRAWINGS

The objects and advantages of the present invention will become more apparent by describing preferred embodiments thereof in detail with reference to the accompanying drawings, wherein.

DETAILED DESCRIPTION OF THE PREFERRED EMBODIMENTS

Figure 1:
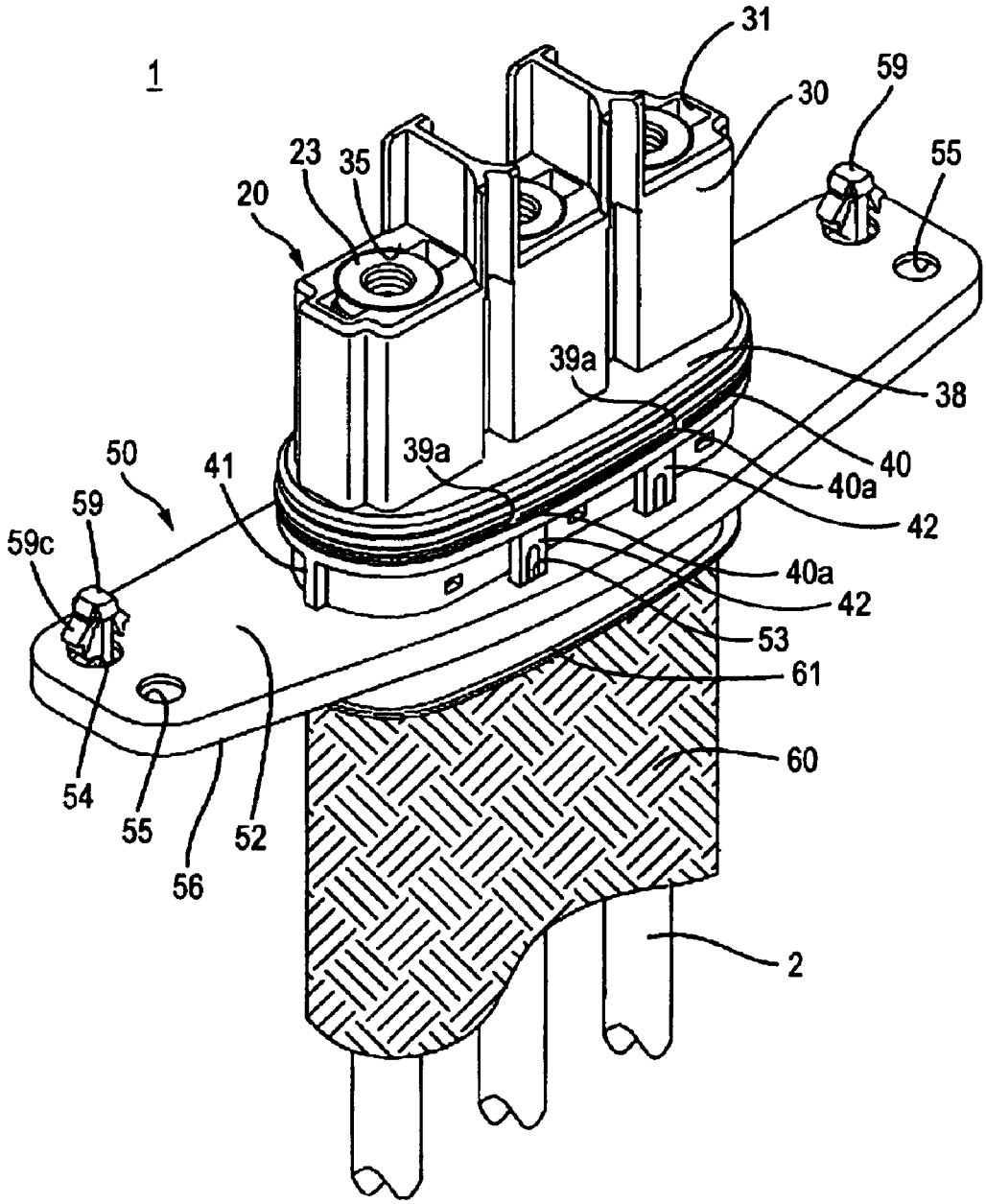
FIG. 1 is a perspective view of a connector according to a first embodiment of the invention.
Figure 2:
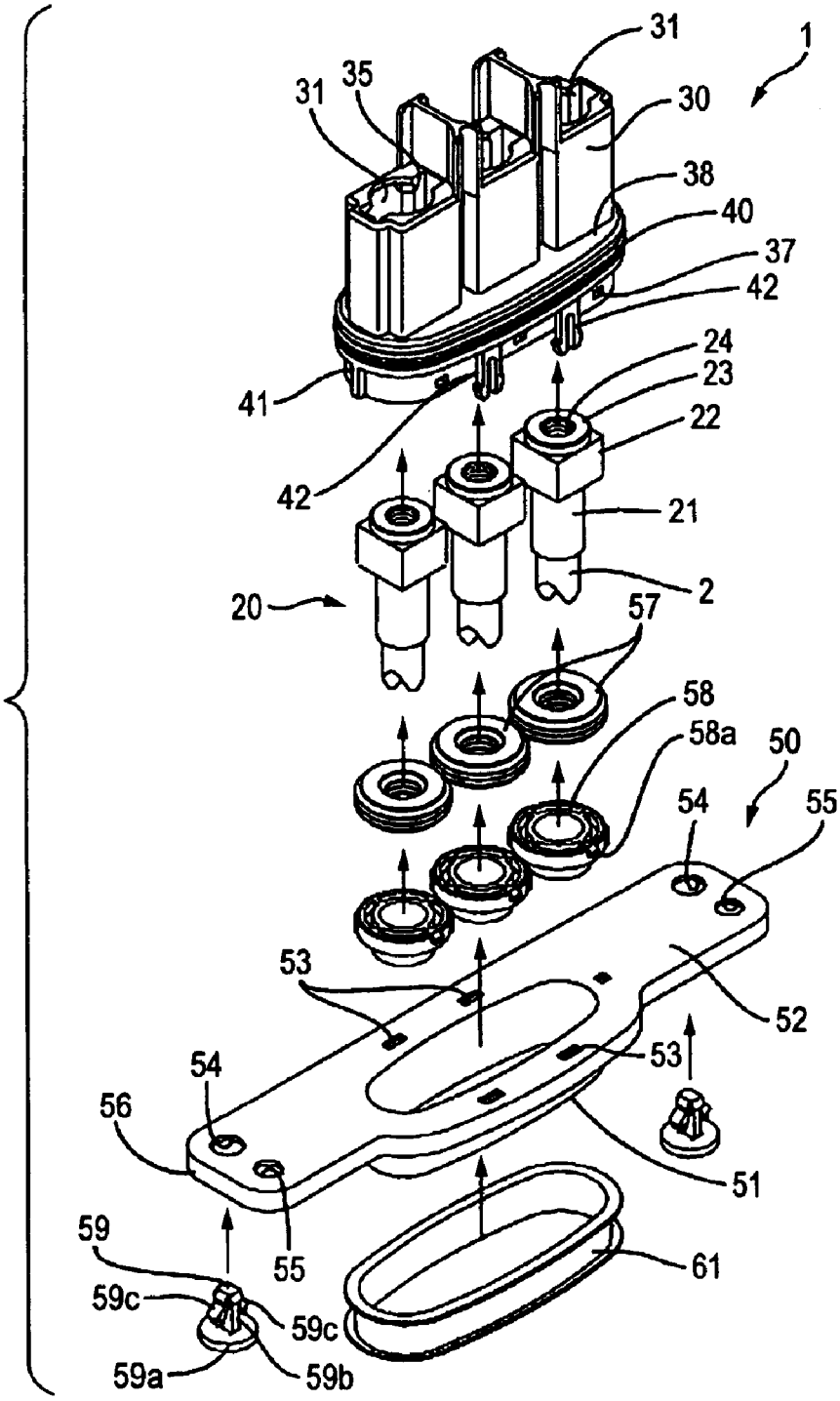
FIG. 2 is an exploded perspective view of the connector.
Figure 3:
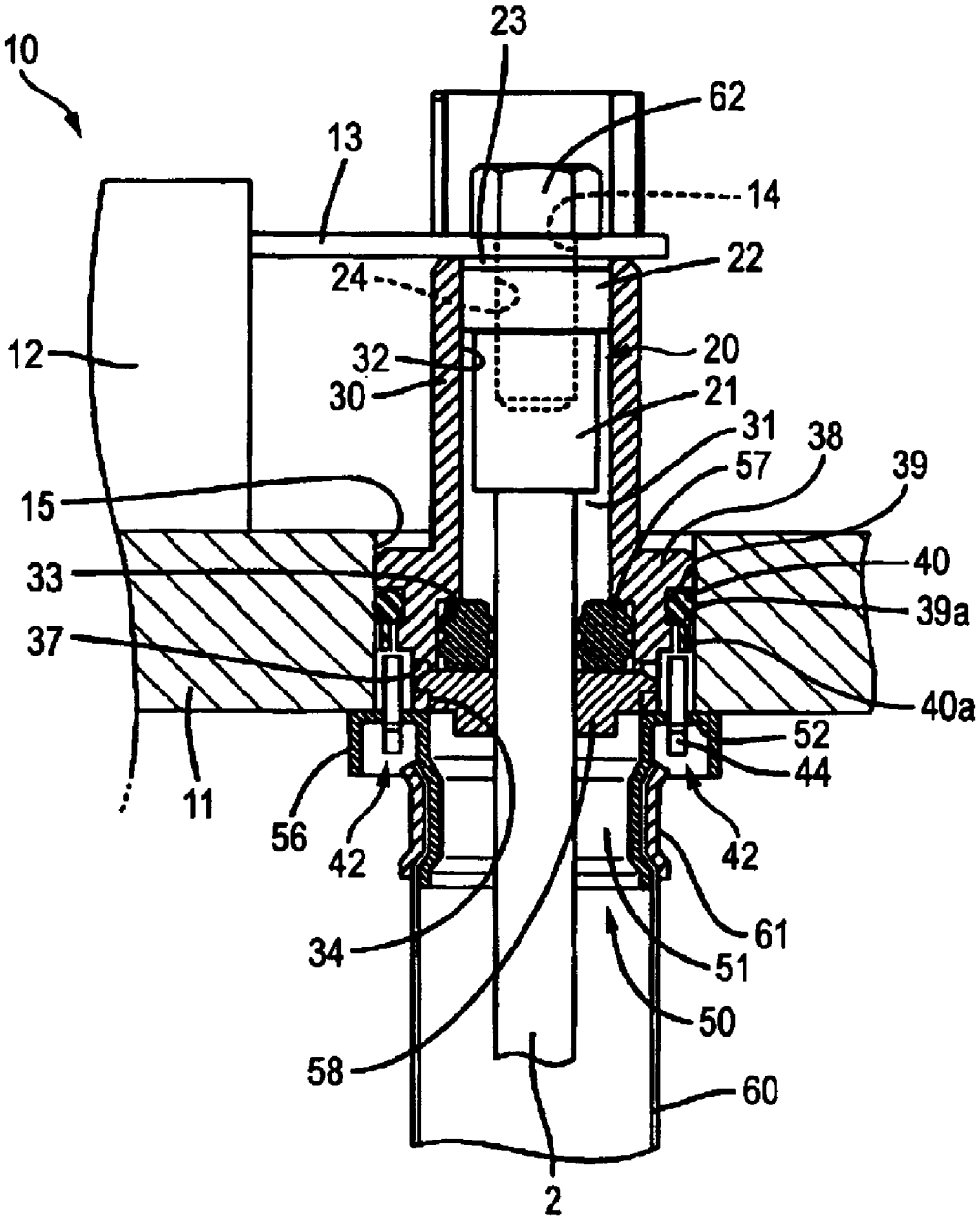
FIG. 3 is a sectional view of the connector attached to equipment.
Figure 4:
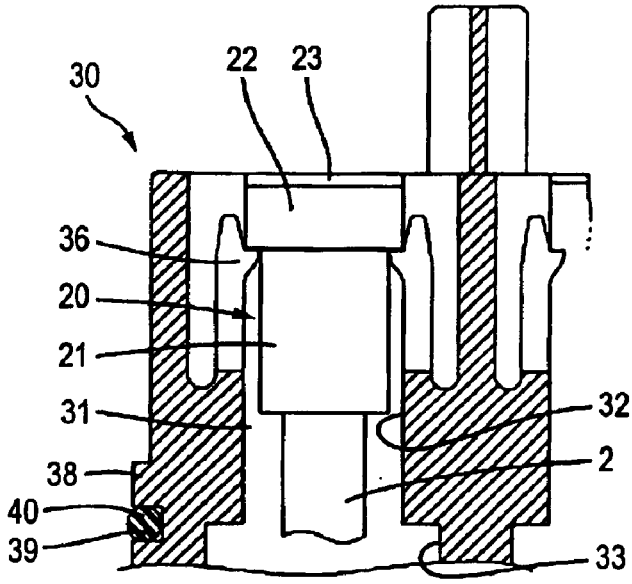
FIG. 4 is a partially enlarged sectional view showing the structure in which a wire-side terminal is retained in a cavity.
Figure 5:
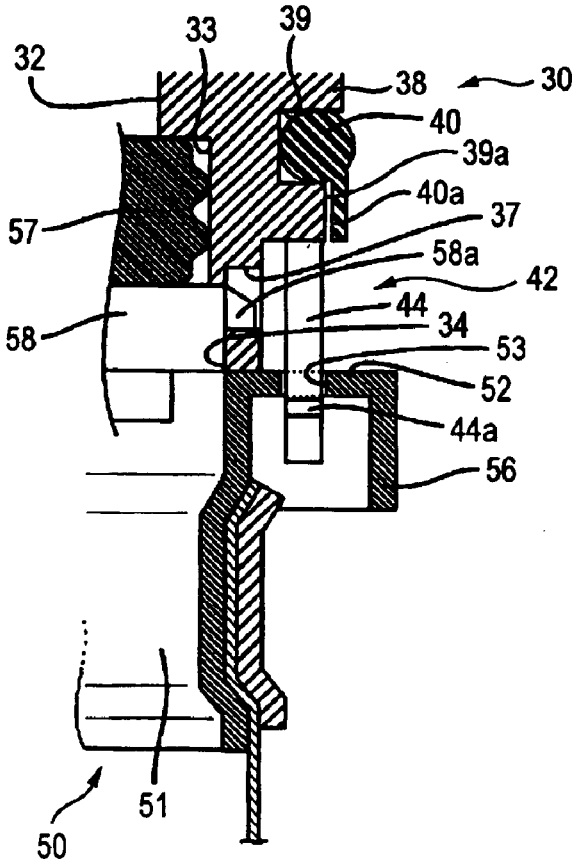
FIG. 5 is a partially enlarged sectional view showing the state where a locking protrusion and a lock hole are engaged with each other.
Figure 6:
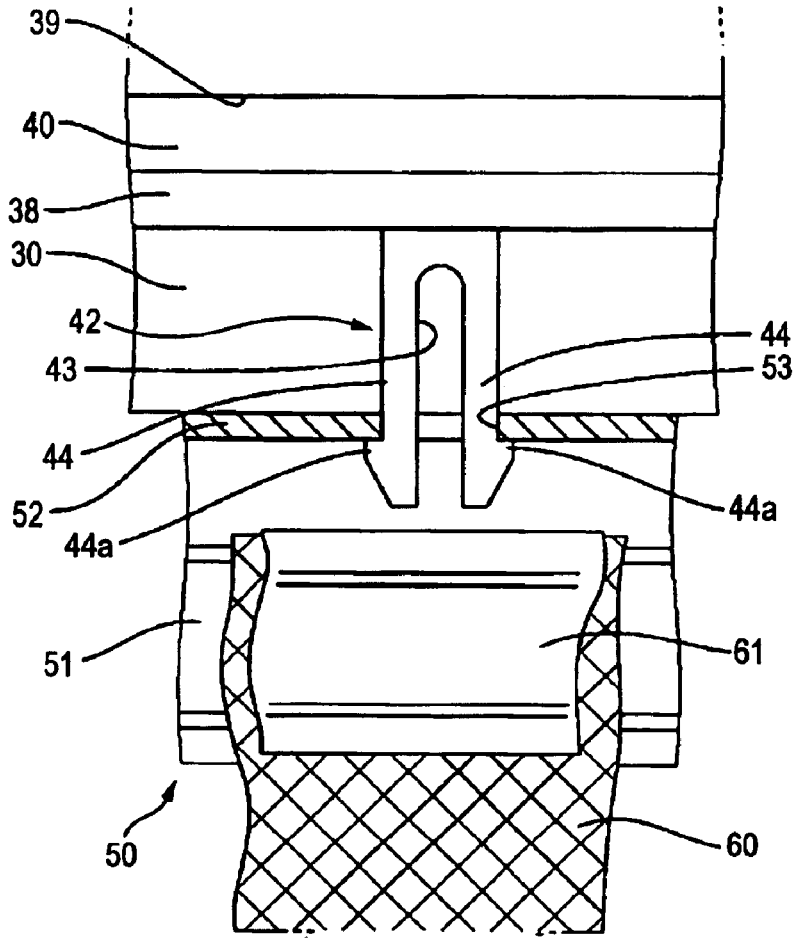
FIG. 6 is a partially cutaway and partially enlarged front view showing the state where the locking protrusion and the lock hole are engaged with each other.
Figure 7:
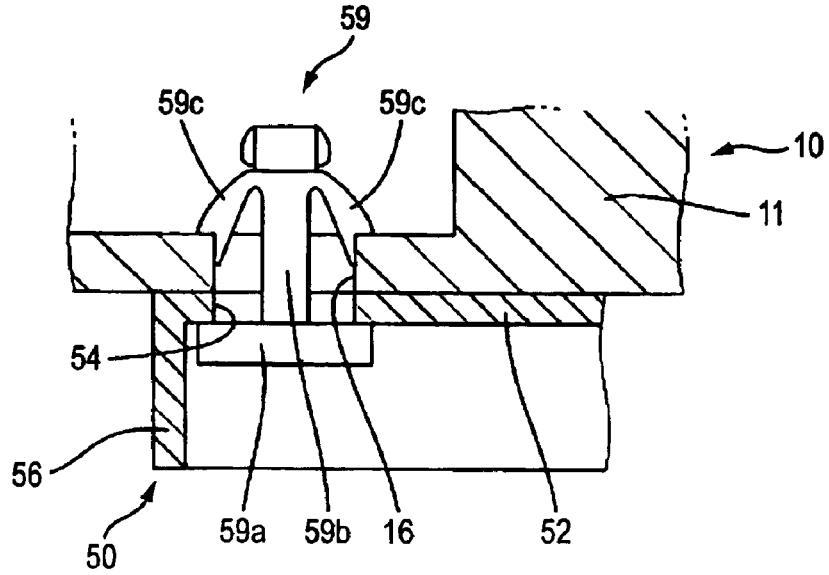
FIG. 7 is a partially enlarged sectional view showing a temporary lock structure between a shielding shell and a shielding casing.
Figure 8:
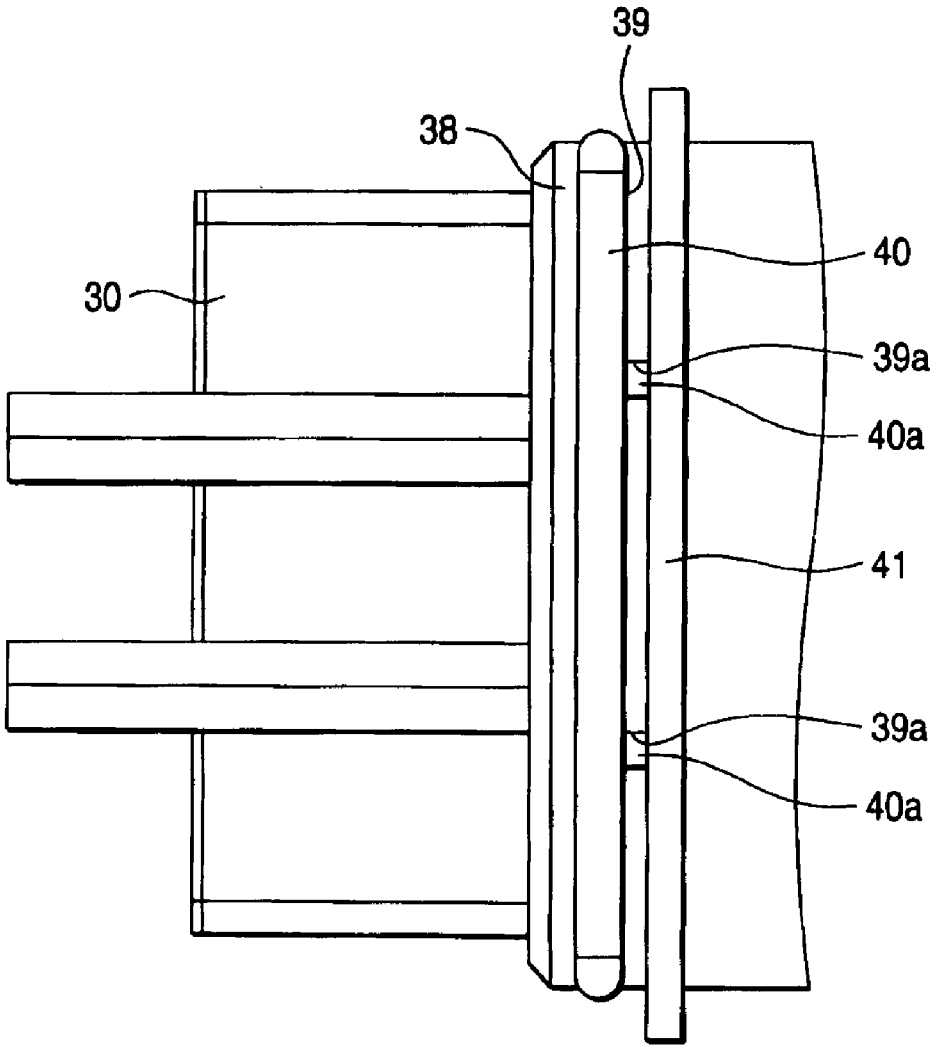
FIG. 8 is a plan view of the connector.

Referring now to the accompanying drawings, a description will be given in detail of preferred embodiments of the invention.

Hereinafter, a connector 1 according to a first embodiment of the invention will be described below with reference to FIGS. 1 through 8. Incidentally, in the following description, the direction connecting the left bottom and the right top in FIGS. 1 and 2 will be defined as a horizontal (left and right) direction, and the direction connecting the left top and the right bottom in the same drawings will be defined as a front/rear direction.

The connector 1 in the first embodiment is to be connected to equipment 10 (for example, inverter unit) of an electric vehicle in upward in upward direction. The equipment 10 accommodates three equipment-side terminals 13 and an equipment main part 12 in a conductive shielding casing 11. The equipment-side terminals 13 extend from the equipment main part 12. Each equipment-side terminal 13 has a shape like a plate called a bus bar, retained in a horizontal posture and in parallel with the other equipment-side terminals 13 in the horizontal (left and right) direction. A bolt hole 14 is formed in each equipment-side terminal 13 so as to penetrate the equipment-side terminal 13 in the vertical (up and down) direction. A mounting hole 15 opened in a substantially elliptic shape long in the horizontal direction correspondingly to the three equipment-side terminals 13 is formed in a horizontal wall of the shielding casing 11 so as to penetrate the shielding casing 11 in the vertical direction. In addition, on each of the opposite, left and right sides of the mounting hole 15 in the shielding casing 11, a temporary lock hole 16 and a threaded hole (not-shown) are formed to align in the horizontal (front and rear) direction.

The connector 1 includes wire-side terminals 20, a housing 30 (corresponding to the retention member of the invention) and a shielding shell 50. The connector 1 is collectively connected to terminal portions of three wires 2 in a lump. In each wire 2, the outer circumference of a conductor is surrounded by an insulating coating. Differently from shielded wires, no shielding layer is provided in the wires 2. The wire-side terminals 20 are connected to the terminal portions of the wires 2 respectively.

Each wire-side terminal 20 has a wire contact-cramping portion 21 in a closed barrel shape (the shape having a hole whose lower end surface is opened) in its lower end portion. The conductor of a wire 2 is received in the wire contact-cramping portion 21, and fixedly and conductively attached thereto by caulking. The wire contact-cramping portion 21 of the wire-side terminal 20 is nearly columnar. The upper end portion of the wire-side terminal 20 is formed as a square portion 22 having dimensions to be circumscribed about the outer circumference of the wire contact-cramping portion 21. Further, a circular portion 23 inscribed in the square portion 22 and coaxial with the wire contact-cramping portion 21 is formed on the upper end surface of the square portion 22. In the wire-side terminal 20 configured thus, a threaded hole 24 is formed to keep its axis in the vertical (up and down) direction and to be open to the upper end surface of the circular portion 23.

The housing 30 is made from synthetic resin, having three cavities 31 arranged in the horizontal (left and right) direction and penetrating the housing 30 in the vertical (up and down) direction. The area ranging from the upper end portion of each cavity 31 to the vicinity of the lower end portion thereof serves as a square receiving chamber for allowing the square portion 22 of the wire-side terminal 20 to be fitted therein without looseness. In the lower end portion of the cavity 31, a rubber stopper receiving portion 33 having a circular shape whose diameter is larger than the square receiving portion 32, and a holder receiving portion 34 are formed to align in the vertical (up and down) direction. In addition, in the upper end edge of the square receiving portion 32 (the opening edge of the cavity 31 in the upper end surface of the housing 30), a stopper 35 is formed to have a circular shape to be fitted to the circular portion 23 of the wire-side terminal 20 without looseness, and to project inward to abut against the upper surface of the square portion 22. Further, in the cavity 31, a pair of lances 36 is formed to extend upward like a cantilever along the two opposite inner wall surfaces of the square receiving portion 32. A detachment preventing hole 37 is formed in the holder receiving portion 34 by notching the inner wall of the holder receiving portion 34.

A fitting portion 38 having a substantially elliptic shape to be fitted into the mounting hole 15 without looseness is formed in the outer circumference of the lower end portion of the housing 30 so as to project to the outside. When the fitting portion 38 is fitted into the mounting hole 15, the housing 30 is positioned horizontally (in the horizontal (front and rear) direction and in the horizontal (left and right) direction) with respect to the shielding casing 11, that is, in a direction perpendicular to the direction with which the housing 30 is fitted into the mounting hole 15. A sealing groove 39 is formed in the outer circumference of the fitting portion 38. A sealing ring 40 is attached to the sealing groove 39. In the area lower than the fitting portion 38 in the outer circumference of the housing 30, ribs 41 are formed to project and be located in the opposite, left and right ends (opposite ends in the direction of the major axis of the ellipse) thereof.

Further, on the lower surface of the fitting portion 38, a pair of locking protrusions 42 (as a coupling unit of the invention) each projecting downward like a cantilever are formed on each of the left and right sides so as to extend along the opposite, front and rear surfaces of the housing 30. That is, four locking protrusions 42 in total are formed. Each locking protrusion 42 has a slit 43 cut upward from the lower end thereof, and a pair of left and right flexible lock pieces 44 having the slit 43 lying therebetween. A protrusion 44*a* is formed in the lower end portion of each flexible lock piece 44 so as to project to the outside.

A shielding shell 50 is a single member formed out of a metal plate material by deep drawing. The shielding shell 50 has a substantially elliptic cylindrical portion 51 substantially corresponding to the outer circumferential shape of the housing 30 under the fitting portion 38, and a flange portion 52 in plate shape extending continuously all over the circumference of the cylindrical portion 51 so as to project horizontally from the upper edge of the cylindrical portion 51 to the outside.

In each of the front and rear portions of the flange portion 52, a pair of left and right lock holes 53 (as a coupling unit of the invention) are formed to penetrate the flange portion 52 in the vertical (up and down) direction. In addition, in each of the opposite, left and right end portions of the flange portion 52, a circular temporary lock hole 54 and a circular bolt hole 55 are formed to align in the horizontal (front and rear) direction.

In the flange portion 52, a rib 56 is continuously formed at the circumference of the flange portion 52 so as to extend downward along the outer circumferential edge of the flange portion 52, that is, substantially perpendicularly to the outer surface of the flange portion 52. The rib 56 is located outside the lock holes 53 (oppositely to the cylindrical portion 51). The flange portion 52 configured thus is brought into close contact with the lower surface (outer wall surface) of the shielding casing 11.

The housing 30 configured thus has a shape corresponding to the mounting hole 15, that is, a substantially elliptic shape long from side to side. In the front end portion (the area in front of the flange portion 52 of the shielding shell 50) in the outer circumference of the housing 30, a circumferential sealing groove 39 is formed continuously all over the circumference. In addition, in the upper surface area in the outer circumference of the housing 30, of the opening edge of the sealing groove 39, the rear edge portion is notched backward in a rectangular shape. Thus, a pair of left and right concave regulating portions 40*a* are formed. The positions of the pair of regulating portions 40*a* are set to be symmetric in the horizontal (left and right) direction. In addition, the two regulating portions 40*a* are made identical in shape and dimensions.

A sealing member 40 made of rubber and having a ring-like shape substantially similar to that of the housing 30 and that of the mounting hole 15 is attached to the sealing groove 39 configured thus. The sectional shape of the sealing member 40 is substantially circular. The inner circumferential portion of the sealing member 40 comes in elastic contact with the groove bottom surface of the sealing groove 39, while the outer circumferential portion of the sealing member 40 comes in elastic contact with the inner circumferential surface of the mounting hole 15. A pair of left and right lock portions 39*a* to be locked in the regulating portions 40*a* of the housing 30 are formed in the sealing member 40. Each lock portion 56 has a rectangular shape to be fitted to the regulating portion 52 with no space therebetween, and is made to project rearward. In addition, the two lock portions 39*a* are disposed correspondingly to the regulating portions 40*a* in the horizontal (left and right) direction. Furthermore, the thickness (radial dimension) of each lock portion 56 is smaller than that of the sealing member 40. In a free state (where the sealing member 40 is not elastically deformed), the outermost circumferential surface of the sealing member 40 is located outside the outer surface of each lock portion 56, while the innermost circumferential surface of the sealing member 40 is located inside the inner surface of each lock portion 56.

The connector 1 has rubber stoppers 57, holders 58 and temporary lock members 59 as well as the aforementioned constituent parts. Each rubber stopper 57 has an annular shape, including lip portions in its inner and outer circumferences. The rubber stopper 57 is attached to the outer circumference of the wire 2, and received in the rubber stopper receiving portion 33 of the cavity 31. Each holder 58 has an annular shape in the same manner as the rubber stopper 57. A detachment preventing protrusion 58*a* is formed on the outer circumference of the holder 58. In each temporary lock member 59, a support portion 59*b* projects over the upper surface of a tab portion 59*a* having a disc-like shape, while a pair of elastic detachment preventing pieces 59*c* extend obliquely downward from the upper end of the support portion 59*b*.

In installing the connector 1, first the wire-side terminals 20 are connected to the wires 2 in advance respectively, and the wire-side terminals 20 are inserted into the cavities 31 from below respectively. The upper surface of the square portion 22 of each inserted wire-side terminal 20 is brought into contact with the stopper 35, while the lances 36 are locked in the lower surface of the square portion 22. Thus, each inserted wire-side terminal 20 is retained in the housing 30 in the state where the floating (detachment and attachment from and to the cavity 31) of the wire-side terminal 20 in vertical direction is being limited. In addition, the rubber stopper 57 and the holder 58 are outer-fitted to each wire W in advance. After the wire-side terminal 20 is received in the cavity 31, the rubber stopper 57 is displaced upward and fitted into the rubber stopper receiving portion 33 of the cavity 31. Thus, sealing is secured between the outer circumference of the wire 2 and the inner circumference of the rubber stopper receiving portion 33 by the rubber stopper 57. After that, the holder 58 is displaced upward so as to be fitted into the holder receiving portion 34 and brought into contact with the lower surface of the rubber stopper 57. Thus, the detachment preventing protrusion 58*a* of the holder 58 is locked in the detachment preventing hole 37 of the housing 30 so that downward detachment of the holder 58 is limited, and hence the rubber stopper 57 received in the cavity 31 is prevented from dropping off downwardly.

On the other hand, the three wires 2 are inserted into a cylindrical shielding member (bracket shield) 60 is formed by a braiding made of a metal fine line braided in a meshed manner. A terminal portion of the shielding member 60 enclosing the three wires 2 collectively is connected to the shielding shell 50. For the connection, the terminal portion of the shielding member 60 is put over the cylindrical portion 51 of the shielding shell 50, and a substantially elliptic caulking ring 61 is fitted to the outer circumference of the terminal portion. Then, the caulking ring 61 is caulked. Thus, as a result of the caulking, the terminal portion of the shielding member 60 is clamped and fixed between the cylindrical portion 51 and the caulking ring 61. In such a manner, conductive connection is secured between the shielding member 60 and the shielding shell 50.

The shielding shell 50 is accommodated in the housing 30 from below. The locking protrusions 42 of the housing 30 are engaged with the lock holes 53 of the shielding shell 50. Thus, both the housing 30 and the shielding shell 50 are integrated. In the course of the incorporation, the elastic lock pieces 44 of the locking protrusions 42 enter the lock holes 53 while bending inward elastically, and the ribs 41 of the housing 30 abut against the upper-surface-side opening edge portion of the cylindrical portion 51. As soon as such a regular state of incorporation is established, the elastic lock pieces 44 exert their own elastic restoring force so that their claw pieces 44*a* are locked in the opening edges on the lower sides of the lock holes 53 respectively. By the abutment of the ribs 41 and the fitting between the locking protrusions 42 and the lock holes 53, the housing 30 and the shielding shell 50 are accommodated in the state their floating in any direction of the vertical (up and down) direction, the horizontal (left and right) direction and the horizontal (front and rear) direction is limited.

In addition, the temporary lock members 59 are attached to the temporary lock holes 54 of the shielding shell 50 from below respectively. Thus, the support portions 59*b* and the elastic detachment preventing pieces 59*c* are made to project above the flange portion 52 in advance. The downward detachment of the attached temporary lock members 59 is limited due to the elastic detachment preventing pieces 59*c* caught in the opening edge portions of the temporary lock holes 54.

The connector 1 accommodated thus is attached by inserting the housing 30 into the mounting hole 15 of the shielding casing 11 from below and bringing the flange portion 52 of the shielding shell 50 into close contact with the lower wall of the shielding casing 11. Between the inner circumferential surface of the mounting hole 15 and the outer circumference of the housing 30 fitted into the mounting hole 15, waterproof is secured by the sealing ring 40 of the housing 30.

Assume that when the sealing member 40 is attached to the sealing groove 39, there is a circumferential misalignment of the sealing member 40 with respect to the sealing groove 39 because the sealing groove 39 and the sealing member 40 have noncircular shapes, that is, substantially elliptic shapes long from side to side. In such a case, there is a fear that there occurs such a problem that a part of the sealing member 40 may float from the sealing groove 39. In this embodiment, however, the regulating portions 40*a* are formed in the sealing groove 39 so as to sink in the direction crossing the circumferential direction, while the lock portions 39*a* are formed in the sealing member 40 so as to project in the direction crossing the circumferential direction. When the regulating portions 40*a* and the lock portions 39*a* are fitted to each other, the sealing member 40 can be positioned circumferentially relatively to the sealing groove 39. Accordingly, in the state where the housing 30 is not fitted into the mounting hole 15, there occurs no problem that the sealing member 40 may float partially from the sealing groove 39, or may be stretched partially. Thus, the sealing member 40 is attached properly to the sealing groove 39 (housing 30).

In addition, the elastic detachment preventing pieces 59*c* of the temporary lock members 59 are made to penetrate the temporary lock holes 16 of the shielding casing 11, and locked in their opening edges. Due to the locking between the temporary lock members 59 and the temporary lock holes 16, the shielding shell 50 and the housing 30, that is, the connector 1 is kept temporarily locked in the shielding casing 11. After that, bolts (not shown) are inserted into the bolt holes 55 of the shielding shell 50 from below, and screwed down to the threaded holes of the shielding casing 11. Thus, the shielding shell 50 is conductively fixed to the shielding casing 11, and hence the connector 1 is attached to the equipment 10 in the state where the floating of the connector 1 is limited.

In this attached state, the upper end surface of each wire-side terminal 20 received in the housing 30 is opposed to the lower surface of the corresponding equipment-side terminal 13 so as to be in contact therewith or at a slight distance therefrom, and further the bolt hole 14 of each equipment-side terminal 13 aligns with the threaded hole 24 of the corresponding wire-side terminal 20. A bolt 62 is inserted into the bolt hole 14, and screwed down to the threaded hole 24. Thus, the wire-side terminals 20 are connected to the corresponding equipment-side terminals 13, respectively, conductively and in the state where the floating of the wire-side terminals 20 is limited.

In the first embodiment, as described above, the wire-side terminals 20 are collectively retained by the housing 30, and the housing 30 is fitted into the mounting hole 15. Accordingly, the housing 30 can be positioned relatively to the shielding casing 11 without providing any bracket in the outer circumference of the housing 30. Since the bracket can be omitted thus, the flange portion 52 can be formed continuously all over the circumference of the shielding shell 50 so that the flange portion 52 can be prevented from being curved and deformed when the shielding shell 50 is formed.

In addition, the rib 56 is formed to rise substantially perpendicularly to the outer surface of the flange portion 52. Accordingly, the rib 56 also exerts a function of increasing the strength of the flange portion 52 having a plate-like shape. In addition, the rib 56 is formed continuously all over the circumference. Accordingly, the effect of increasing the strength is enhanced. Since the strength of the flange portion 52 is enhanced thus, the flange portion 52 is prevented from being curved and deformed. Thus, the reliability of contact of the flange portion 52 with the shielding casing 11 is improved.

In addition, the locking protrusions 42 of the housing 30 are locked in the lock holes 53 of the shielding shell 50 so that the housing 30 is integrally coupled with the shielding shell 50. Accordingly, the process of attaching the housing 30 to the mounting hole 15 and the work of attaching the shielding shell 50 to the shielding casing 11 can be carried out by one action. Thus, the workability is improved.

Since the front end portions (lower end portions) of the locking protrusions 42 penetrate the flange portion 52 and project on the outer surface side (lower surface side) thereof, there is a fear that the locking protrusions 42 may be broken or deformed due to interference of foreign matters. In the first embodiment, however, the rib 56 extending on the lower surface side (outer surface side) where the lower end portions of the locking protrusions 42 project is formed at the outer circumferential edge of the flange portion 52 (that is, outside the locking protrusions 42). Accordingly, the rib 56 acts as a protecting member. Thus, foreign matters are prevented from interfering with the locking protrusions 42. In addition, since the lower end edge of the rib 56 extends down below the lower ends of the locking protrusions 42, the effect of preventing foreign matters from interfering with the locking protrusions 42 is enhanced.

In addition, in the state where the shielding shell 50 and the housing 30 accommodated in the shielding casing 11 are coupled with each other, the shielding shell 50 and the housing 30 are temporarily locked in the shielding casing 11 by the temporary lock members 59. Accordingly, it is not necessary to press the shielding shell 50 and the housing 30 onto the shielding casing 11 by hand during the work of fixing the shielding shell 50 to the shielding casing 11. Thus, the workability is improved.

In the first embodiment, as described above, the three wire-side terminals 20 are collectively retained by the housing 30, and the housing 30 is fitted into the mounting hole 15 of the shielding casing 11. Accordingly, the number of man-hours can be reduced in comparison with a structure in which a plurality of wire-side terminals are attached to mounting holes individually. In addition, not shielded wires each having a shield function but non-shielded type wires 2 are used, and the wires 2 are surrounded by a cylindrical shielding member in a lump, while the shielding shell 50 is fixedly attached to the terminal of the shielding member so as to be connected to the shielding casing 11. Accordingly, the number of man-hours can be reduced in comparison with a structure in which shielded wires are connected to a shielding casing individually.

In addition, the locking protrusions 42 of the housing 30 are locked in the lock holes 53 of the shielding shell 50 so that the housing 30 is integrally coupled with the shielding shell 50. Accordingly, the process of attaching the housing 30 to the mounting hole 15 and the work of attaching the shielding shell 50 to the shielding casing 11 can be carried out by one action. Thus, the workability is further improved.

The locking protrusions 42 project on the outer surface side (lower surface side) of the flange portion 52. Therefore, the locking protrusions 42 may be broken or deformed due to interference of foreign matters. However, in the embodiment, a rib 56 bent on the lower surface side (outer surface side) of the flange portion 52, that is, on the side where the locking protrusions 42 project is formed at the circumferential edge of the flange portion 52. In addition, the lower end edge of the rib 56 extends downward under the lower ends of the locking protrusions 42. Accordingly, by means of the rib 56, foreign matters can be surely prevented from interfering with the locking protrusions 42. Further, the rib 56 is formed to rise from the outer surface of the flange portion 52 at substantially right angles. Accordingly, the rib 56 also exerts a function of increasing the strength of the flange portion 52 having a plate-like shape.

In addition, in the state where the shielding shell 50 and the housing 30 incorporated in the shielding casing 11 are coupled with each other, the shielding shell 50 and the housing 30 are temporarily locked in the shielding casing 11 by the temporary lock members 59. Accordingly, it is not necessary to press the shielding shell 50 and the housing 30 onto the shielding casing 11 by hand during the work of fixing the shielding shell 50 to the shielding casing 11. Thus, the workability is improved.

The gap between the outer circumference of the fixed housing 30 and the inner circumference of the mounting hole 15 is sealed liquid-tightly by the sealing member 40. Here, since the sealing member 40 is circumferentially positioned properly with respect to the housing 30 by the fitting between the regulating portions 40*a* and the lock portions 39*a*, the sealing member 40 is elastically deformed uniformly all over the circumference, and hence circumferentially uniform sealing performance can be obtained. Thus, the shielded wires 20 are attached to the equipment 10.

Although the outer circumferential shape of the housing 30, the inner circumferential shape of the mounting hole 15 and the sealing member 40 are substantially elliptic, that is, noncircular in this embodiment as described above, the waterproof function using the sealing member 40 can be exerted surely because the sealing member 40 is positioned circumferentially with respect to the housing 30 due to the fitting between the lock portions 39*a* formed in the sealing member 40 and the regulating portions 40*a* formed in the housing 30, and because the circumferential floating of the sealing member 40 with respect to the housing 30 is limited.

In addition, the sealing member 40 is attached to the outer circumference of the housing 30 while the fitting between the regulating portions 40*a* and the lock portions 39*a* is carried out in the state where they are exposed to the outer surface of the housing 30. Thus, the locking state between the regulating portions 40*a* and the lock portions 39*a* can be confirmed visually before the housing 30 is fitted into the mounting hole 15.

Figure 9:
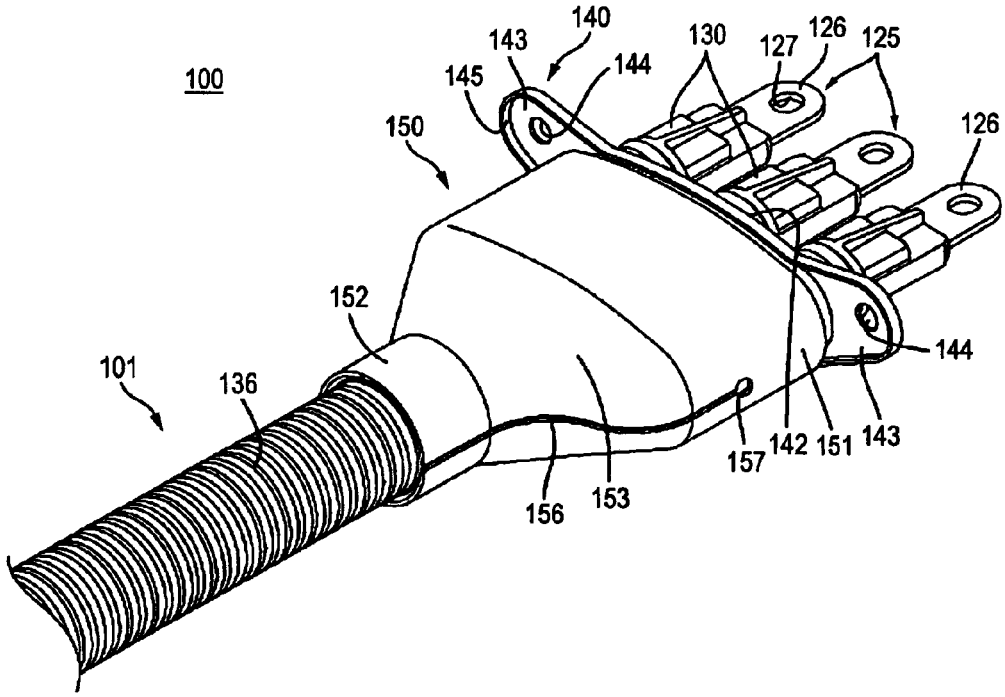
FIG. 9 is a perspective view of a connector according to a second embodiment of the invention.
Figure 10:
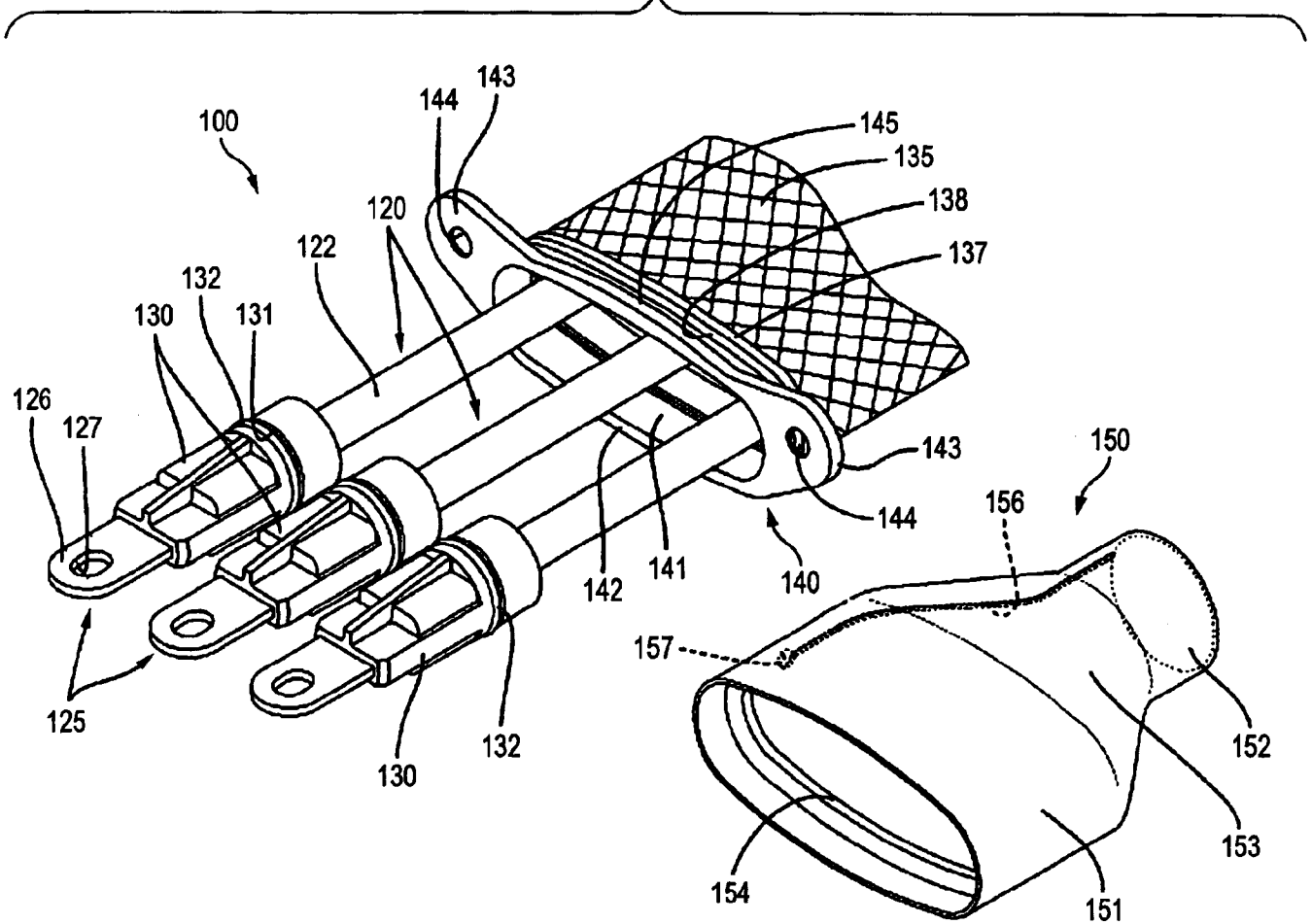
FIG. 10 is a perspective view showing the state where a cover has been removed from a sealing member.
Figure 11:
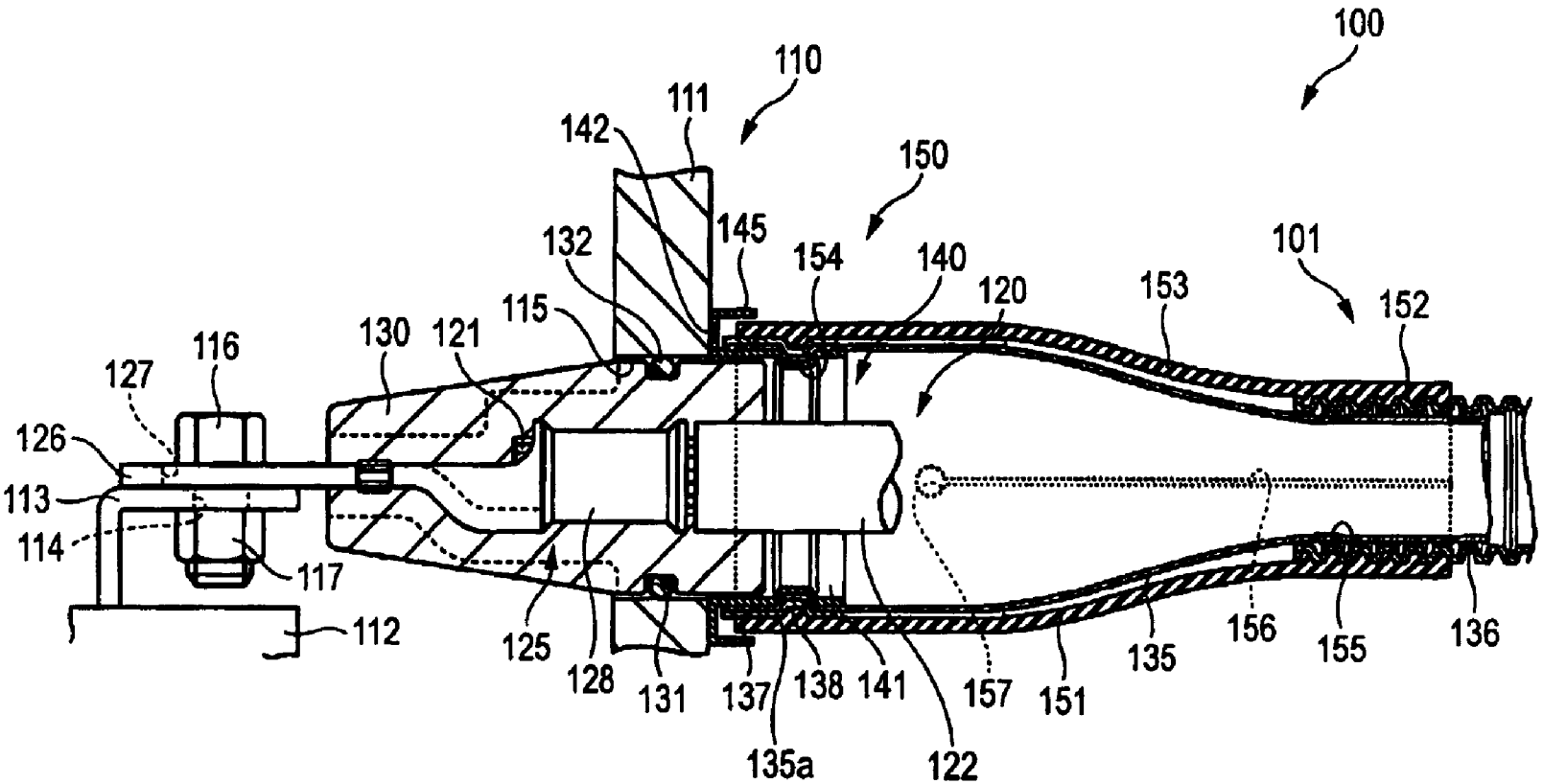
FIG. 11 is a sectional view showing the connector connected to equipment.

Hereinafter, a connector 100 according to a second embodiment of the invention will be described with reference to FIGS. 9 through 11.

The connector 100 in the second embodiment is used for connecting a shielded wire harness 101 to equipment 110 such as an inverter unit or a motor in an electric vehicle.

The equipment 110 accommodates an equipment main part 112 and three equipment-side terminals 113 in a conductive shielding casing 111. The equipment-side terminals 113 extend from the equipment body 112. Each equipment-side terminal 113 has a shape like a plate bent into a substantially L-shape, called a bus bar. A bolt hole 114 is formed in the horizontal portion of each equipment-side terminal 113 so as to penetrate the equipment-side terminal 113 in the vertical (up and down) direction. Three circular mounting holes 115 are formed in a side wall of the shielding casing 111 so as to align in the horizontal (left and right) direction correspondingly to the equipment-side terminals 13 respectively.

The wire harness 101 is constituted by a plurality of wires 120, a shielding member 135 and a corrugated tube 136.

Each wire 120 is different from shielded wires in that the outer circumference of a conductor 121 is surrounded by an insulating coating 122, but no shielding layer is provided in the wire 120. A wire-side terminal 125 is connected to the terminal portion of each wire 120.

The shielding member 135 is formed by a cylindrical braiding made of a metal thin wire braided in a meshed manner. The shielding member 135 collectively encloses the three wires 120. The shielding member 135 can expand and contract in radial and in lengthwise direction due to the flexibility of the metal thin wire.

The corrugated tube 136 is made from synthetic resin, having a cylindrical shape comprised of a large number of bellows lined up. Thus, the corrugated tube 136 can be deformed elastically desirably. The three wires 120 are inserted into the corrugated tube 136 in a lump. The inner diameter of the corrugated tube 136 is set to be a required minimum that can substantially keep the three wires 120 bundled in a triangle. Incidentally, in the corrugated tube 136, an expanding slot (not shown) is formed in the length direction of the corrugated tube 136 so as to extend all over the length thereof. Normally the corrugated tube 136 keeps the cylindrical shape in which the expanding slot is closed due to the elastic restoring force of the corrugated tube 136 itself.

The connector 100 includes wire-side terminals 125, sheath pieces 130 (corresponding to the housing of the invention), a shielding shell 140, and a cover 150.

The approximately first half part of each wire-side terminal 125 is formed as an equipment connecting portion 126 which has a shape like a flat plate long in the horizontal (front and rear) direction and in which a bolt hole 127 is formed. The approximately second half part of the wire-side terminal 125 is formed as a wire connecting portion 128 having a shape of a so-called open barrel shape. The conductor 121 of the wire 120 is conductively connected to the wire connecting portion 128 by cramp contact.

Each sheath piece 130 is molded out of resin integrally with the corresponding wire-side terminal 125 so as to surround the rear end portion of the equipment connecting portion 126 and the whole of the wire connecting portion 128 of the wire-side terminal 125, and the front end portion of the insulating coating 122. The equipment connecting portion 126 of the wire-side terminal 125 projects from the front end surface of the sheath piece 130. On the other hand, the portion of the wire 120 covered with the insulating coating 122 is led out from the rear end surface of the sheath piece 130. The outer circumference of the rear end portion of the sheath piece 130 is formed into a circular portion coaxial with the wire 120. A sealing ring 132 is attached to a sealing groove 131 in the outer circumferential surface of the circular portion. The sheath pieces 130 configured thus are fitted into the mounting hole 115 so as to be positioned relatively to the shielding casing 111 in the vertical (up and down) and horizontal (left and right) directions perpendicular to the fitting direction.

The shielding shell 140 is a single part formed out of a metal plate material by deep drawing. The shielding shell 140 has a substantially elliptic cylindrical portion 141 long from side to side as a whole, a plate-like flange portion 142 projecting from the front end edge of the cylindrical portion 141 to the outside all over the circumference thereof, and a pair of flange portions 143 extending obliquely upward and outward from the opposite, left and right end portions of the flange portion 142 respectively so as to be flush with each other. The front surfaces of the flange portion 142 and the flange portions 143 are brought into surface contact with the outer wall surface of the shielding casing 111. Bolt holes 144 corresponding to threaded holes (not shown) of the shielding casing 111 are formed in the flange portions 143.

A rib 145 is formed continuously all over the circumference of the shielding shell 140 so as to follow the outer circumferential edges of the flange portion 142 and the flange portions 143 and to extend rearward substantially perpendicularly to the circumference of the shielding shell 140.

The cover 150 is made of rubber, having a cylindrical shape as a whole. The front end portion of the cover 150 is formed as a large-diameter portion 151 having a substantially elliptic shape similar to the cylindrical portion 141 of the shielding shell 140. The rear end portion of the cover 150 is formed as a small-diameter portion 152 having a circular shape in the same manner as the corrugated tube 136. The large-diameter portion 151 and the small-diameter portion 152 are connected through a tapered portion 153 expanding gradually to be longer from side to side and to have a larger size in the vertical (up and down) direction at a position closer to the front. A large-diameter-side fitting portion 154 comprised of a protrusion bar extending circumferentially is formed on the inner circumference of the large-diameter portion 151. A small-diameter-side fitting portion 155 having a plurality of circumferential irregularities formed continuously in the axial direction is formed in the inner circumference of the small-diameter portion 152. In addition, in the right side surface portion of the cover 150, a slit 156 cut to be long and narrow is formed to range from the rear end (opening edge of the small-diameter portion 152) of the cover 150 to the large-diameter portion 151 through the tapered portion 153. The front end of the slit 156 does not reach the front end of the cover 150, but is located substantially in the middle of the large-diameter portion 151 in the front/rear direction. A circular hole 157 having a larger diameter than the width of the slit 156 is formed in the front end portion of the slit 156.

The connector 100 and the wire harness 101 are connected in the following manner.

First, each wire-side terminal 125 is cramped with the terminal of the corresponding wire 120, and the wire-side terminal 125 and the sheath piece 130 are integrated by mold forming. In addition, the three wires 120 are inserted into the shielding member 135 in advance. The terminal portions of the wires 120 and the wire-side terminals 125 are led out to the outside of the shielding member 135 so as to spread in the horizontal (left and right) direction not to interfere with each other. In addition, a major part of the wires 120 except their terminal portions are bundled in a triangle. In this state, the corrugated tube 136 is attached to the outer circumference of the shielding member 135. The corrugated tube 136 is set to have an inner diameter small enough to internally touch a triangle formed by bundling the three wires 120, practically. Thus, a major part of the wires 120 except their terminal portions are retained to be bundled in a triangle. Thus, the diameter of the shielding member 135 is reduced to prevent the meshes of the braiding from opening, while the shielding member 135 follows the inner circumference of the corrugated tube 136.

The terminal portion of the shielding member 135 is exposed to the outside from the terminal portion of the corrugated tube 136. As described previously, the three wire-side terminals 125 are led out from the terminal of the corrugated tube 136 so as to spread in the horizontal (left and right) direction. In accordance with this arrangement, the terminal portion of the shielding member 135 is also largely spread in the horizontal (left and right) direction while the size in the vertical (up and down) direction is also increased. Thus, an increased-diameter portion **135*a*** is formed.

The increased-diameter portion **135*a* in the terminal portion of the shielding member 135 is connected to the shielding shell 140. For the connection, the increased-diameter portion 135*a* is put over the cylindrical portion 141 of the shielding shell 140 from behind, and a caulking ring 137 having a substantially elliptic shape is fitted to the outer circumference of the cylindrical portion 141. The caulking ring 137 is caulked. As a result of this caulking, the terminal portion of the increased-diameter portion 135*a* is fixedly put between the cylindrical portion 141 and the caulking ring 137 so that the shielding member 135 and the shielding shell 140 are connected conductively. In addition, as a result of the caulking, a caulking groove 138 extending circumferentially is formed in the outer circumference of the caulking ring 137**.

After the caulking, the cover 150 is attached to surround the increased-diameter portion **135*a* of the shielding member 135. For the attachment of the cover 150, the cover 150 is elastically deformed to open the slit 156 so that the opening portion of the small-diameter portion 152 is expanded temporarily. In that state, the cover 150 is put, from the front, over the three wire-side terminals 125, the terminal portions of the three wires 120, the shielding shell 140, the increased-diameter portion 135***a* of the shielding member 135 and the terminal portion of the corrugated tube 136 in that order.

When the cover 150 passes through the flange portion 142 and the flange portions 143 of the shielding shell 140, the cover 150 is restored to its initial shape so as to close the slit 156. The large-diameter side fitting portion 154 of the cover 150 is fitted into the caulking groove 138, while the small-diameter side fitting portion 155 is fitted to the irregular portion in the outer circumference of the terminal portion of the corrugated tube 136. As a result of the fitting of the two fitting portions 154 and 155, the cover 150 is integrated with the shielding shell 140 and the corrugated tube 136. In this state, the large-diameter portion 151 of the cover 150 encloses the caulking portion between the cylindrical portion 141 of the shielding shell 140 and the increased-diameter portion 135*a* of the shielding member 135, the tapered portion 153 encloses the approximately second half portion of the increased-diameter portion 135*a*, and the small-diameter portion 152 encloses the terminal portion of the corrugated tube 136. In addition, the increased-diameter portion 135*a* of the shielding member 135 follows the inner circumference of the cover 150 practically.

Incidentally, the front end edge of the large-diameter portion 151 of the cover 150 is located on the inner circumferential side with respect to the rib 145 of the shielding shell 140. Accordingly, there is no fear that foreign matters interfere the front end portion of the cover 150 externally.

Finally, in order to prevent the cover 150 from being detached from the corrugated tube 136, an adhesive tape (not shown) is wound spirally over the range from the outer circumference of the small-diameter portion 152 of the cover 150 to the outer circumference of the corrugated tube 136. It is desired that the adhesive tape is wound to cover all the length of the slit 156. In addition, it is desired that the adhesive tape is also wound to cover all the length of the corrugated tube 136 so as to close the expanding slot.

Thus, the connection between the connector 100 and the wire harness 101 is completed. After that, the sheath pieces 130 are fitted into the mounting holes 115 of the shielding casing 111 respectively. The fitted sheath pieces 130 are positioned relatively to the shielding casing 111. Incidentally, in each mounting hole 115, sealing is secured between the inner circumference of the mounting hole 115 and the outer circumference of the sheath piece 130 by the sealing ring 132. In addition, the equipment connecting portion 126 of the wire-side terminal 125 penetrating the mounting hole 115 is put on the upper surface of the equipment-side terminal 113 lying ahead in the shielding casing 111, so that the bolt holes 114 and 127 of both the equipment-side terminal 113 and equipment connecting portion 126 are aligned. Then, a nut 117 is screwed down and fastened to a bolt 116 passed through both the bolt holes 114 and 127. Thus, both the terminals 113 and 125 are fixed in the state where their swinging is limited, while they are connected conductively.

When the terminals 113 and 125 have been connected with each other, the shielding shell 140 is attached to the shielding casing 111. For the attachment, the bolt holes 144 of the shielding shell 140 are aligned with the threaded holes of the shielding casing 111, and bolts (not shown) inserted into the bolt holes 144 are screwed down and fastened to the threaded holes. Thus, the shielding shell 140 is fixed to the shielding casing 111, and connected thereto conductively. In such a manner, the shielding member 135 is connected to the shielding casing 111 through the shielding shell 140, and the attachment of the connector 100 to the equipment 110 is completed.

In the second embodiment, as described above, the wire-side terminals 125 are retained by the sheath pieces 130, and the sheath pieces 130 are fitted into the mounting holes 115. Accordingly, the sheath pieces 130 can be positioned relatively to the shielding casing 111 without providing any bracket in the outer circumferences of the sheath pieces 130. Since the bracket can be omitted thus, the flange portion 142 and the flange portions 143 can be formed continuously all over the circumference of the shielding shell 140 so that the flange portion 142 and the flange portions 143 can be prevented from being curved and deformed when the shielding shell 140 is formed.

In addition, the rib 145 is formed to rise substantially perpendicularly to the outer surfaces of the flange portion 142 and the flange portions 143. Accordingly, the rib 145 also exerts a function of increasing the strength of the flange portion 142 and the flange portions 143 each having a plate-like shape. In addition, the rib 145 is formed continuously all over the circumference. Accordingly, the effect of increasing the strength is enhanced. Since the strength of the flange portion 142 and the flange portions 143 is enhanced thus, the flange portion 142 and the flange portions 143 are prevented from being curved and deformed. Thus, the reliability of contact of the flange portion 142 and the flange portions 143 with the shielding casing 111 is improved.

In addition, the shielding member 135 is surrounded by the cover 150 to be thereby protected. In the edge portion of the cover 150 on the side of the shielding shell 140, the opening edge thereof follows the outer surface of the flange portion 142. Thus, in the second embodiment, there is a slight gap between the opening edge of the cover 150 and the outer surface of the flange portion 142. For that reason, there is a fear that foreign matters may enter the gap so as to turn up the opening edge of the cover 150 toward the outside. In the second embodiment, however, the rib 145 extending and bent toward the outer surfaces of the flange portion 142 and the flange portions 143 is formed at the outer circumferential edges of the flange portion 142 and the flange portions 143. Thus, since the rib 145 is located outside the opening edge of the cover 150, foreign matters are prevented from interfering with the opening edge of the cover 150 by the rib 145. In such a manner, the cover 150 is prevented from turning up.

In addition, the extending end edge of the rib 145 extends at the rear of the opening edge of the cover 150 so that the inner circumferential surface of the rib 145 is opposed to the outer circumference of the opening edge portion of the cover 150. That is, the rib 145 encloses the opening edge portion of the cover 150 and all the circumference of the gap between the opening edge of the cover 150 and the outer surface of the flange portion 142. Thus, foreign matters can be surely prevented from interfering with the opening edge portion of the cover 150.

In addition, in the wire harness 101, the shielding member 135 made of a braided wire is surrounded by the corrugated tube 136, and an end portion of the shielding member 135 is made to project from the corrugated tube 136 so that the diameter thereof is increased. The increased-diameter portion 135*a* of the shielding member 135 is covered with the cover 150. Thus, the increased-diameter portion 135*a* is protected surely.

In addition, the cover 150 is made of elastically deformable rubber. Accordingly, the cover 150 does not have to be detached from the increased-diameter portion 135*a*, for example, when the shielding shell 140 and the increased-diameter portion 135*a* of the shielding member 135 are moved temporarily toward the corrugated tube 136 in order to insert the wire-side terminals 125 into the mounting holes 115 of the shielding casing 111.

Further, the cover 150 made of rubber makes it possible to flexibly deal with the case where the wires 120 and the increased-diameter portion 135*a* are bent with a small radius of curvature between the shielding shell 140 and the corrugated tube 136.

In addition, the cover 150 has the large-diameter portion 151 corresponding to the shielding shell 140 and the small-diameter portion 152 corresponding to the corrugated tube 136. Since the slit 156 cut from the opening end of the cover 150 on the side of the small-diameter portion 152 is formed in the cover 150, the small-diameter portion 152 of the cover 150 does not have to be expanded forcibly against the elastic force when the shielding shell 140 and the increased-diameter portion 135*a* of the shielding member 135 are passed through the cover 150 after the shielding shell 140 is fixedly attached to the increased-diameter portion 135*a*. Thus, the workability is improved.

In addition, the large-diameter-side fitting portion 154 and the small-diameter-side fitting portion 155 are formed in the cover 150, and the fitting portions 154 and 155 are fitted into the caulking groove 138 and the irregular portion of the outer circumference of the corrugated tube 136 respectively. Thus, the cover 150 is prevented from being detached from the corrugated tube 136 and the shielding shell 140.

The invention is not limited to the embodiments explained in the description and the drawings. For example, the following embodiments are also included in the technical scope of the invention, and further various modifications other than the following embodiments can be made without departing from the gist of the invention.

(1) Although a flange portion serving as means for attaching a shielding shell to a shielding casing is formed integrally with the shielding shell in the embodiments, the attachment means to the shielding casing may be provided as an exclusive part separated from the shielding shell.

(2) Although wire-side terminals are accommodated in a housing molded in advance in the embodiments, the wire-side terminals and the housing may be integrated by insert molding or mold forming according to the invention.

(3) Although a temporary locking unit for the shielding casing is provided in the shielding shell in the embodiments, the temporary locking unit may be provided in the housing according to the invention.

(4) Although the embodiments describe the case where the equipment is an inverter unit of an electric vehicle, the invention is also applicable to the case where the equipment is another unit (for example, a motor provided on wheels) other than the inverter unit of an electric vehicle.

(5) Although the first embodiment describes the case where three wire-side terminals are retained in one housing in a lump, the number of wire-side terminals to be retained in one housing may be two or not smaller than four according to the invention.

(6) Although the first embodiment describes the case where a waterproof sealing ring is provided, the invention is also applicable to a non-waterproof connector having shielding shell having no sealing ring.

(7) Although a housing and a shielding shell are integrated by locking protrusions and lock holes in the first embodiment, according to the invention the housing and the shielding shell do not have to be integrated, but the work of fitting the housing into a mounting hole and the work of incorporating the shielding shell into a shielding casing are carried out in different steps respectively.

(8) Although the sealing member is attached to the outer circumference of the housing in the first embodiment, the sealing member may be attached to the inner circumference of the mounting hole according to the invention. In this case, the regulating portions for locking the lock portions of the sealing member therein are formed in the mounting hole.

(9) Although the outer circumferential shape of the housing and the inner circumferential shape of the mounting hole are made substantially elliptic in the first embodiment, they may be set to be not the elliptic shape but another shape such as an oval shape, or a substantially rectangular shape having arc-shaped corners according to the invention.

(10) Although the locking state between the regulating portions and the lock portions can be observed visually in the first embodiment, according to the invention the lock portions may be provided on the inner circumferential side of the sealing member so that the locking state cannot be confirmed visually. In this case, the lock structure using irregularities between the regulating portions and the lock portions is hidden inside the sealing member. Thus, the appearance is improved.

(11) Although the regulating portions are made concave while the lock portions are made convex in the first embodiment, according to the invention the regulating portions may be made convex while the lock portions are made concave. Alternatively, a convex regulating portion and a concave regulating portion may be provided while a concave lock portion and a convex lock portion are provided.

(12) Although the regulating portions are disposed only on the upper surface side of the housing in the first embodiment, according to the invention the regulating portions may be formed only on the lower surface side of the housing, or may be formed on both the upper and lower surfaces of the housing.

(13) Although two regulating portions are provided in the first embodiment, according to the invention the number of regulating portions may be one or not smaller than three.

(14) Although the regulating portions are disposed symmetrically in the horizontal (left and right) direction in the first embodiment, two regulating portions may be disposed asymmetrically in the horizontal (left and right) direction according to the invention.

(15) Although the two regulating portions are made identical in shape and dimensions in the first embodiment, two or more regulating portions may be made different in shape and dimensions according to the invention.

(16) Although wire-side terminals are retained in sheath pieces individually and respectively in the second embodiment, according to the invention a plurality of wire-side terminals may be retained in one sheath piece collectively.

(17) Although the sheath pieces retaining the wire-side terminals and the shielding shell are attached to the shielding casing in the state where they are separated from each other in the second embodiment, according to the invention the sheath pieces and the shielding shell may be attached to the shielding casing in the state where they have been coupled by a lock portion or the like.

(18) Although a slit is provided in a cover in the second embodiment, according to the invention the cover may be provided with no slit.

(19) Although the cover is made of rubber easy to be elastically deformed in the second embodiment, according to the invention the cover may be made of synthetic resin difficult to be elastically deformed. In this case, when the cover is formed into two half split parts, the incorporating work becomes easy.

(20) Although an end portion of the cover is outer-fitted to the corrugated tube in the second embodiment, according to the invention the end portion of the cover does not have to be fitted to the end portion of the corrugated tube.

(21) Although the end portion of the cover is fitted to the shielding shell in the second embodiment, according to the invention the end portion of the cover does not have to be fitted to the shielding shell.

(22) Although the cover is formed so that the slit does not reach the opening edge on the large-diameter portion side but the large-diameter portion is formed into a cylindrical shape continuous all over the circumference in the second embodiment, according to the invention the slit may be formed in a range from the opening edge on the small-diameter portion side to the opening edge on the large-diameter portion side. Also in this case, the cover retains its cylindrical shape due to its elastic restoring force. In addition, when an adhesive tape is wound around the outer circumference of the cover, the cover can be prevented from being expanded and deformed.

(23) Although a tapered portion whose diameter varies gradually is provided between the large-diameter portion and the small-diameter portion of the cover in the second embodiment, according to the invention such a tapered portion does not have to be provided, but the large-diameter portion and the small-diameter portion may be formed continuously to have a diameter varying stepwise.

(24) Although a slight gap is formed between the opening edge of the cover and the outer surface of the flange portion of the shielding shell in the second embodiment, according to the invention the opening edge of the cover may abut against the outer surface of the flange portion with no gap therebetween.

According to the invention, the wire-side terminals are retained by a housing collectively, and the housing is fitted into a mounting hole. Accordingly, the housing can be positioned relatively to a shielding casing without any bracket provided in the outer circumference of the housing. Since the bracket can be omitted thus, the flange portion of the shielding shell can be formed to be continuous all over the circumference. Thus, the flange portion is prevented from being curved and deformed when the shielding shell is formed. Further, since a rib is formed at the circumferential edge of the flange portion, the flange portion is prevented from being curved and deformed by the rib. Thus, since the flange portion is surely prevented from being curved and deformed in such a manner, the reliability of contact of the flange portion with the shielding casing is improved. Further, due to the rib formed in the flange portion, foreign matters can be prevented from interfering with any member located on the outer circumferential side of the flange portion.

The housing and the shielding shell can be coupled integrally by the lock portion. Accordingly, the work of fitting the housing into the mounting hole and the work of attaching the shielding shell to the shielding casing can be attained by one action. Thus, the workability is improved. In addition, since the rib bent on the outer surface side is provided in the flange portion, foreign matters can be prevented from interfering with any projecting portion of the locking protrusion even if the locking protrusion projects on the outer surface side of the flange portion.

An end portion of the shielding member is covered and protected by a cover. In addition, the opening edge of the cover follows the outer surface of the flange portion. Since the rib bent on the outer surface side is formed in the flange portion, foreign matters are prevented from interfering with the opening edge of the cover by the rib. Thus, the cover is prevented from turning up.

A plurality of wire-side terminals are retained by a housing collectively, and the housing is fitted into a mounting hole. Accordingly, the number of man-hours can be reduced in comparison with a structure in which a plurality of wire-side terminals are attached to mounting holes individually. In addition, not shielded wires each having a shield function but non-shielded type wires are used, and the wires are surrounded by a cylindrical shielding member in a lump, while a shielding shell is fixedly attached to the terminal of the shielding member so as to be attached to a shielding casing. Accordingly, the number of man-hours can be reduced in comparison with a structure in which shielded wires are connected to a shielding casing individually.

The housing and the shielding shell can be coupled integrally with each other by coupling units. Accordingly, the work of attaching the housing to the mounting hole and the work of attaching the shielding shell to the shielding casing can be carried out by one action. Thus, the workability is further improved.

A locking protrusion projects on the outer surface side of a flange portion. Therefore, there is a fear that the locking protrusion may be broken or deformed due to interference of foreign matters. According to the invention, however, a protective wall bent on the outer surface side, that is, on the side where the locking protrusion projects is formed at the circumferential edge of the flange portion. Thus, foreign matters can be prevented from interfering with the locking protrusion by the protective wall. In addition, the protective wall is formed to rise from the outer surface of the flange portion. Accordingly, the strength of the flange portion having a plate-like shape can be increased.

The shielding shell and the housing accommodated in the shielding casing as they have been coupled with each other are temporarily locked in the shielding casing by a temporary locking unit. Accordingly, it is not necessary to press the shielding shell and the housing onto the shielding casing by hand during the work of fixing the shielding shell to the shielding casing. Thus, the workability is improved.

Even when the outer circumferential shape of the housing, the inner circumferential shape of the mounting hole and the sealing member have a noncircular shape such as an elliptic shape, circumferential floating of the sealing member is regulated by locking between the lock portion and the regulating portion, so that the sealing member is positioned circumferentially. Due to this positioning, the sealing member is positioned relatively to the outer circumference of the housing or the inner circumference of the mounting hole. Thus, the waterproof function using the sealing member is attained surely.

The regulating portion is formed to be exposed on the outer surface of the housing, while the sealing member is attached to the outer circumference of the housing.

Accordingly, the locking state between the regulating portion and the lock portion can be confirmed visually before the housing is fitted into the mounting hole.

Although the present invention has been shown and described with reference to a specific embodiment, various changes and modifications will be apparent to those skilled in the art from the teachings herein. Such changes and modifications as are obvious are deemed to come within the spirit, scope and contemplation of the invention as defined in the appended claims.

What is claimed is:

1. A connector to be attached to equipment in which a plurality of terminals are provided in a shielding casing and a mounting hole is formed on the shielding casing, the connector comprising:

a plurality of terminals fixedly attached to an end portion of a plurality of wires and configured to be connected to the terminals of the equipment, respectively;

a housing configured to retain the plurality of terminals and to be fit into the mounting hole; and a shielding shell having conductive characteristic and fixedly attached to an end portion of a braided shield member enclosing the plurality of wires collectively, the shielding shell being configured to be connected to the shielding casing, wherein each of the housing and the shielding shell comprises a coupling units configured to be locked to each other to thereby couple the housing and the shielding shell with each other, wherein the shielding shell comprises a flange portion formed in plate-shape and configured to abut against an outer wall surface of the shielding case, and wherein the coupling units comprises a lock hole formed on the flange portion and a locking protrusion configured to be locked in the lock hole in a manner projecting on an outer surface side of the flange portion.

2. A connector to be attached to equipment in which a plurality of terminals are provided in a shielding casing and a mounting hole is formed on the shielding casing, the connector comprising:

a plurality of terminals fixedly attached to an end portion of a plurality of wires and configured to be connected to the terminals of the equipment, respectively;

a housing configured to retain the plurality of terminals and to be fit into the mounting hole; and a shielding shell having conductive characteristic and fixedly attached to an end portion of a braided shield member enclosing the plurality of wires collectively, the shielding shell being configured to be connected to the shielding casing, wherein the shielding shell comprises a flange portion formed in plate-shape and configured to abut against an outer wall surface of the shielding case, and wherein the flange portion comprises a protective wall formed by bending a circumferential edge thereof on the outer surface side.

3. A connector to be attached to equipment in which a plurality of terminals are provided in a shielding casing and a mounting hole is formed on the shielding casing, the connector comprising:

a plurality of terminals fixedly attached to an end portion of a plurality of wires and configured to be connected to the terminals of the equipment, respectively;

a housing configured to retain the plurality of terminals and to be fit into the mounting hole;

a shielding shell having conductive characteristic and fixedly attached to an end portion of a braided shield member enclosing the plurality of wires collectively, the shielding shell being configured to be connected to the shielding casing; and a temporary locking unit disposed on at least either of the shielding shell and the housing and configured to temporarily lock the connector to the shielding casing.

4. A connector to be attached to equipment in which a plurality of terminals are provided in a shielding casing and a mounting hole is formed on the shielding casing, the connector comprising:

a plurality of terminals fixedly attached to an end portion of a plurality of wires and configured to be connected to the terminals of the equipment, respectively;

a housing configured to retain the plurality of terminals and to be fit into the mounting hole;

a shielding shell having conductive characteristic and fixedly attached to an end portion of a braided shield member enclosing the plurality of wires collectively, the shielding shell being configured to be connected to the shielding casing; and a sealing member formed in a ring shape and configured to secure waterproof between the outer circumference of the housing and the inner circumference of the mounting hole.

5. The connector as claimed in claim 4, wherein the sealing member comprises a lock portion configured to regulate a circumferential floating of the sealing member relative to the housing or to the mounting hole.

6. The connector as claimed in claim 5, wherein the lock portion is configured to be locked to a regulating portion provided in the mounting hole.

7. The connector as claimed in claim 5, wherein the housing comprises a regulating portion configured to be locked by the lock portion.

8. The connector as claimed in claim 7, wherein the regulating portion is formed to be exposed on the outer surface of the housing, and wherein the sealing member is attached to the outer circumference of the housing.

9. A connector to be attached to equipment in which a plurality of terminals are provided in a shielding casing and a mounting hole is formed on the shielding casing, the connector comprising:

a plurality of terminals fixedly attached to an end portion of a plurality of wires and configured to be connected to the terminals of the equipment, respectively;

a housing configured to retain the plurality of terminals and to be fit into the mounting hole; and a shielding shell having conductive characteristic and fixedly attached to an end portion of a cylindrical shielding member enclosing the plurality of wires collectively, the shielding shell being configured to be connected to the shielding casing, wherein each of the housing and the shielding shell comprises a coupling units configured to be locked to each other to thereby couple the housing and the shielding shell with each other, wherein the shielding shell comprises a flange portion formed in plate-shape and configured to abut against an outer wall surface of the shielding case, and wherein the coupling units comprises a lock hole formed on the flange portion and a locking protrusion in which configured to be locked in the lock hole in a manner projecting on a outer surface side of the flange portion.

10. A connector to be attached to equipment in which a plurality of terminals are provided in a shielding casing and a mounting hole is formed on the shielding casing, the connector comprising:

a plurality of terminals fixedly attached to an end portion of a plurality of wires and configured to be connected to the terminals of the equipment, respectively;

a housing configured to retain the plurality of terminals and to be fit into the mounting hole; and a shielding shell having conductive characteristic and fixedly attached to an end portion of a cylindrical shielding member enclosing the plurality of wires collectively, the shielding shell being configured to be connected to the shielding casing, wherein the shielding shell comprises a flange portion formed in plate-shape and configured to abut against an outer wall surface of the shielding case, and wherein the flange portion comprises a protective wall formed by bending a circumferential edge thereof on the outer surface side.

11. A connector to be attached to equipment in which a plurality of terminals are provided in a shielding casing and a mounting hole is formed on the shielding casing, the connector comprising:

a plurality of terminals fixedly attached to an end portion of a plurality of wires and configured to be connected to the terminals of the equipment, respectively;

a housing configured to retain the plurality of terminals and to be fit into the mounting hole;

a shielding shell having conductive characteristic and fixedly attached to an end portion of a cylindrical shielding member enclosing the plurality of wires collectively, the shielding shell being configured to be connected to the shielding casing; and a temporary locking unit disposed on at least either of the shielding shell and the housing and configured to temporarily lock the connector to the shielding casing.

12. A connector to be attached to equipment in which a plurality of terminals are provided in a shielding casing and a mounting hole is formed on the shielding casing, the connector comprising:

a plurality of terminals fixedly attached to an end portion of a plurality of wires and configured to be connected to the terminals of the equipment, respectively;

a housing configured to retain the plurality of terminals and to be fit into the mounting hole;

a shielding shell having conductive characteristic and fixedly attached to an end portion of a cylindrical shielding member enclosing the plurality of wires collectively, the shielding shell being configured to be connected to the shielding casing; and a sealing member formed in a ring shape and configured to secure waterproof between the outer circumference of the housing and the inner circumference of the mounting hole.

13. The connector as claimed in claim 12, wherein the sealing member comprises a lock portion configured to regulate a circumferential floating of the sealing member relative to the housing or to the mounting hole.

14. The connector as claimed in claim 13, wherein the lock portion is configured to be locked to a regulating portion provided in the mounting hole.

15. The connector as claimed in claim 13, wherein the housing comprises a regulating portion configured to be locked by the lock portion.

16. The connector as claimed in claim 15, wherein the regulating portion is formed to be exposed on the outer surface of the housing, and wherein the sealing member is attached to the outer circumference of the housing.

* * * * *